United States Patent [19]

Nakamura

[11] Patent Number: 4,725,833

[45] Date of Patent: Feb. 16, 1988

[54] TONE CONTROL DEVICE IN MONOCHROMATIC TONE DISPLAY APPARATUS

[75] Inventor: Nobutaka Nakamura, Tokyo, Japan

[73] Assignee: Kabushiki Kaisha Toshiba, Kawasaki, Japan

[21] Appl. No.: 782,398

[22] Filed: Oct. 1, 1985

[30] Foreign Application Priority Data

Feb. 28, 1985 [JP] Japan ..... 60-39256

[51] Int. Cl.[4] ..... G09G 1/16

[52] U.S. Cl. ..... 340/793; 340/703; 358/30; 358/32

[58] Field of Search ..... 340/703, 793, 791; 358/81, 82, 30, 32, 283

[56] References Cited

U.S. PATENT DOCUMENTS

| | | | |
|---|---|---|---|
| 4,158,200 | 6/1979 | Seitz et al. | 340/793 |
| 4,236,175 | 11/1980 | Groothuis | 358/30 |
| 4,251,755 | 2/1981 | Bryden | 340/793 |
| 4,481,529 | 11/1984 | Kerling | 358/82 |

OTHER PUBLICATIONS

IBM Personal Computer XT Hardware Reference Library, Technical Reference, "IBM Color/Graphic Monitor Adaptor", (No Date of Publication).

*Primary Examiner*—Gerald L. Brigance

*Attorney, Agent, or Firm*—Finnegan, Henderson, Farabow, Garrett & Dunner

[57] ABSTRACT

In a tone control device in a monochromatic tone display apparatus, when an intensity signal and at least one of the R, G and B signals is active, an AND gate generates a maximum tone level signal. A selector/adder having OR gates and resistors receives the maximum tone level signal and the R, G and B signals. When the maximum tone level signal is inactive, the selector/adder generates a tone level signal in response to the active state of the R, G and B signals. When the maximum tone level signal is active and all the R, G and B signals are inactive, the selector/adder generates a minimum tone level voltage. However, when the maximum tone level signal and at least one of the R, G and B signals is active, the selector/adder generates a maximum tone level voltage.

8 Claims, 3 Drawing Figures

TONE CONTROL DEVICE IN MONOCHROMATIC TONE DISPLAY APPARATUS

BACKGROUND OF THE INVENTION

The present invention relates to a monochromatic tone display apparatus for producing a pseudocolor display by using a monochromatic display device.

A monochromatic tone system is defined as a system for producing a pseudocolor display by using a monochromatic display. Tone levels are determined in correspondence with respective colors, and tone differences are expressed on the monochromatic display by utilizing tone level differences. For example, one-bit I (intensity) data is added to the 3-bit data of R·G·B to represent 8 colors and to format the 4-bit data of I·R·G·B which can express 16 tones corresponding to 16 colors. When the 4-bit data is displayed on the monochromatic display, the 4-bit data can display a maximum of 16 tones. In other words, 16 tone levels are given in correspondence with 16 colors. The I bit is set at logic "0" in the normal mode, and at logic "1" in an emphasizing mode.

A typical example is described in "IBM Personal Computer XT Hardware Reference Library Technical Reference". However, this reference describes only interface color graphic specifications. No description is made of a compression tone display which serves as the main feature of the present invention.

Assume that the 4-bit data of I·R·G·B is weighted to provide a color code $C=I\times 8+R\times 4+G\times 2+B$, and that numbers 0 through 15 are given by Cs, respectively, as shown in FIG. 1. The smaller the color code, the lower the tone level. The larger the color code, the higher the tone level.

According to the above-described system, however, since the difference between the adjacent tone levels is small, the difference cannot be easily identified. In addition, since the I bit among the I, R, G and B bits has the maximum weight coefficient, the screen is darkened when the I bit is enabled.

SUMMARY OF THE INVENTION

It is an object of the present invention to provide a monochromatic tone display apparatus wherein the conventional 16 tones are compressed to 9 tones to increase the difference between each two adjacent tone levels.

In order to achieve the object of the present invention, there is provided, in a display apparatus, a tone display control device for producing a monochromatic tone display corresponding to red (R), green (G), and blue (B) signals, as well as to an intensity (I) signal, in synchronism with a horizontal synchronizing (HSYNC) signal and a vertical synchronizing (VSYNC) signal, upon reception of the HSYNC, VSYNC, R, G, B and I signals, comprising:

first means for generating different tone level voltages in response to combinations, given such that at least one of the R, G and B signals is active when the I signal is inactive; and second means for generating both a minimum tone level voltage when the I signal is active and all the R, G and B signals are inactive, and a maximum tone level voltage when one or a combination of the R, G and B signals is active.

In a monochromatic tone display apparatus according to the present invention, when the I bit is set at logic "0", eight color codes represented by the 3-bit R·G·B data are respectively assigned to eight tone levels. However, when the I bit is set at logic "1", the maximum tone level is assigned to the color code irrespective of the logic state of the 3-bit R·G·B data. 16 colors can be expressed by a total of 9 tone levels. Therefore, since the difference between each two adjacent tone levels can be increased, the difference can be easily identified. Even if the I bit is set at logic "1", the screen will not be darkened.

The present invention provides the following effects:

(1) Since the difference between each two adjacent tone levels is increased, the display contents can be easily recognized;

(2) Even if the I bit is set at logic "1", the screen will not be darkened; and (3) Since the difference between the tone levels for the I bit of logic "1" and for the I bit of logic "0" is increased, the primary function (i.e., an emphasizing function) of the I bit can be properly performed.

BRIEF DESCRIPTION OF THE DRAWINGS

Other objects and features of the present invention will be apparent from the following description taken in connection with the accompanying drawings, in which.

DETAILED DESCRIPTION OF THE PREFERRED EMBODIMENT

Figure 1:
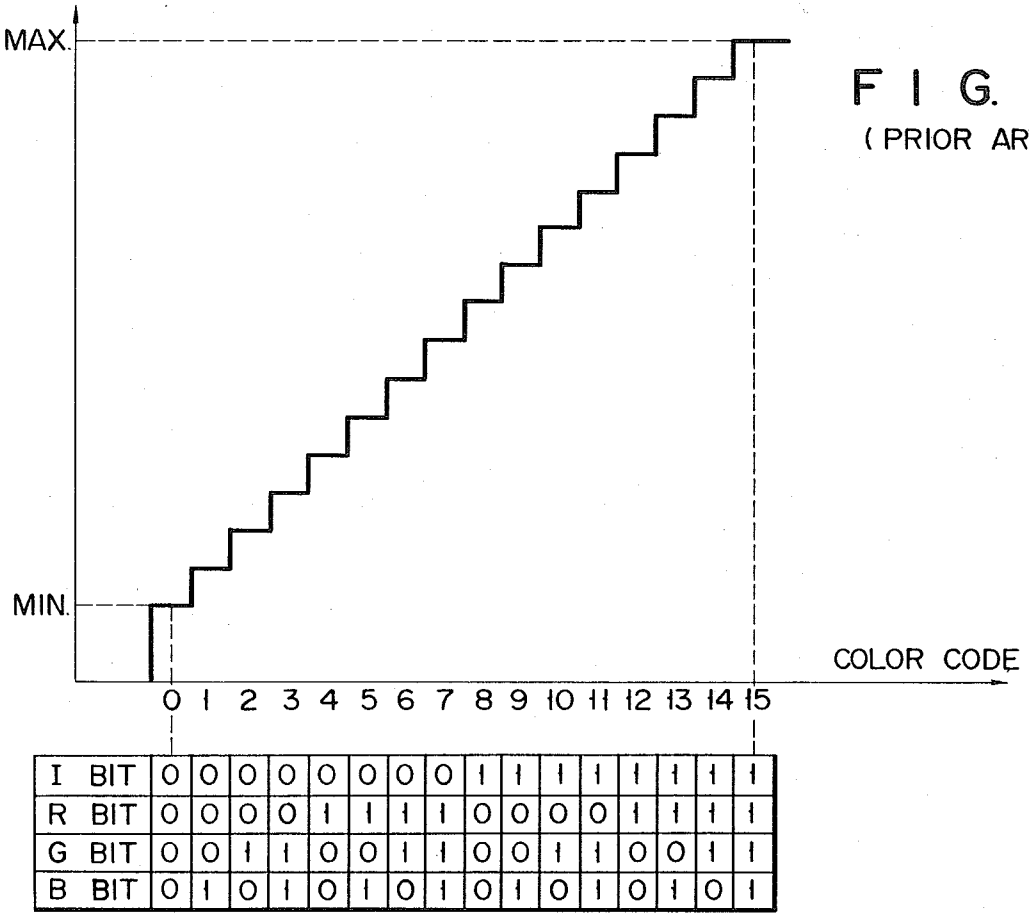
FIG. 1 (PRIOR ART)
FIG. 1 is a diagrammatic representation showing the relationship between the color codes, the tone levels and the I, R, G and B bits in a conventional 16-tone system.
Figure 2:
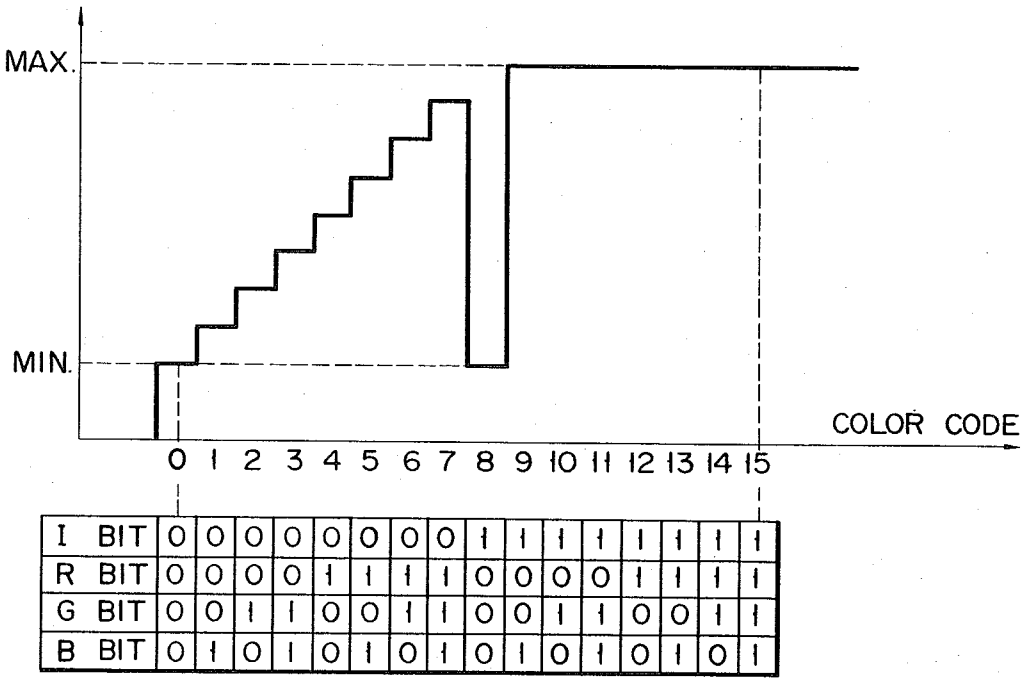
FIG. 2 is a diagrammatic representation showing the relationship between the color codes, the tone levels and the I, R, G and B bits in a 9-tone system according to the present invention.

FIG. 2 is a diagrammatic representation showing the relationship between the color codes, the tone levels and the I, R, G and B bits in a 9-tone system. In this embodiment, when an intensity (I) bit is set at logic "0", eight color codes represented by the 3-bit data of R·G·B are assigned to eight tone levels, respectively. However, when the I bit is set at logic "1", the maximum level is assigned to the color code irrespective of the 3-bit data of R·G·B. The color codes are assigned with a total of 9 tone levels. When the I bit is set at logic "1" and all the R, G and B bits are set at logic "0", the color code consisting of the 4-bit data of I·R·G·B is assigned to the minimum level in the same manner as the 4-bit data of all "0"s. As a comparison, the relationship between the color codes, the tone levels and the I, R, G and B bits in the 16-tone system is diagrammatically illustrated in FIG. 1.

Figure 3:
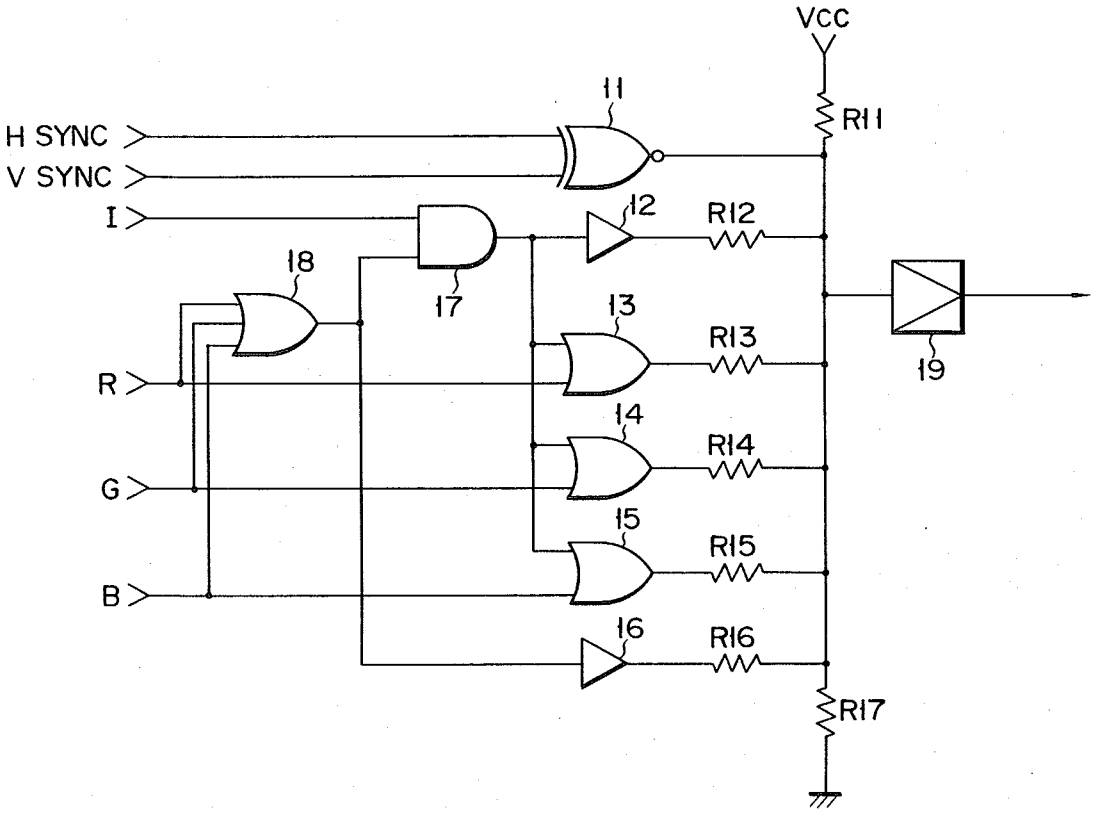
FIG. 3 is a block diagram of a monochromatic tone display apparatus according to an embodiment of the present invention.

FIG. 3 is a block diagram of a monochromatic tone display apparatus according to an embodiment of the present invention. A horizontal synchronizing signal (HSYNC) and a vertical synchronizing signal (VSYNC) generated from a display controller (not shown) are supplied to an inverted exclusive OR gate 11. The I bit (the intensity signal) is supplied to one input terminal of an AND gate 17. The R, G and B signals are supplied to an OR gate 18 and one input terminal of each of the OR gates 13, 14 and 15. An output signal from the OR gate 18 is supplied to the other input terminal of the AND gate 17 and a buffer 16. An output signal from the AND gate 17 is supplied to a buffer 12 and the other input terminal of each of the OR gates 13, 14 and 15. The buffer 12, the OR gates 13, 14 and 15, and the buffer 16 are commonly connected to an amplifier 19 through corresponding resistors R12, R13, R14, R15 and R16. An output terminal of the non-exclusive OR gate 11 is connected to output terminals of the gates 13 through 15 and the buffers 12 and 16. At the same time, the inverted exclusive OR gate 11 is also connected to a power source voltage VCC through the resistor R11, and grounded through resistor R17.

The buffers 12 and 16 are arranged to synchronize with propagation delay times of the gates 13 through 15. When one of the HSYNC and VSYNC signals is set at logic "1", the OR gate 11 generates a logic "0" signal. When one of the R, G or B signals is set at logic "1", the OR gate 18 generates an output signal of logic "1". This output signal is supplied to the other input terminal of the AND gate 17. When the I signal is set at logic "1", the AND gate 17 generates, through the buffer 12, a signal indicating that the tone is of the maximum level. The OR gate 13 generates a signal indicating, similarly, that the R signal is of the maximum level, the OR gate 14 generates a signal indicating that the G signal is of the maximum level, the OR gate 15 generates a signal indicating that the B signal is of the maximum level, and the buffer 16 generates a signal indicating that one of the R, G and B signals is present.

The resistor R11 constitutes a pull-up resistor; R12 through R16 constitute open collector resistors for the buffer 12, the OR gates 13 through 15, and the buffer 16; and R17 constitute a pull-down resistor. These resistors collectively act as an adder from which the total voltage from the active resistors is applied to the amplifier 19.

According to the experimental results of this application, the following resistances are preferable:

R11=220 ohms
R12=820 ohms
R13=220 ohms
R14=470 ohms
R15=910 ohms
R16=470 ohms
R17=240 ohms The operation of the monochromatic tone display apparatus having the arrangement described above will be described in detail with reference to FIGS. 2 and 3. As shown in FIG. 2, assume all the I, R, G and B bits are set at logic "0". When the HSYNC or VSYNC signal supplied from the display controller (not shown) is set at logic "1", an output signal from the OR gate 11 is set at logic "0". An output potential at the amplifier 19 is the ground potential. As shown in FIG. 2, the tone level signal is of the minimum level.

When only the B signal is set at logic "1", the resistors R15 and R16 are active. A total voltage from the resistors R15 and R16 is applied to the amplifier 19. Furthermore, when only the G signal is set at logic "1", the resistors R14 and R16 are active. The total resistance of the resistors R14 and R16 is smaller than that of the resistors R15 and R16, so that the total voltage from the resistors R14 and R16 is higher than that of the resistors R15 and R16. Similarly, when the R, G and B signals are set at logic "1", the resistors R13, R14 and R15 are active. The total voltage from the resistors R13 through R16 is applied to the amplifier 19. As shown in FIG. 2, the tone level is increased in a stepwise manner.

When the I bit is set at logic "1" and all the R, G and B bits are set at logic "0", an output from the OR gate 18 is set at logic "0", and an output from the AND gate 17 is set at logic "0" accordingly. Therefore, since all the resistors R12 through R16 are inactive, the tone level is of the minimum level, as shown in FIG. 2.

When the I bit is set at logic "1" and one or all of the R, G and B bits are set at logic "1", an output signal from the AND gate 17 is, likewise, set at logic "1". Consequently the resistor R12 is active. The signal of logic "1" from the AND gate 17 is supplied to the OR gates 13, 14 and 15, and their outputs are set at logic "1" irrespective of the logic levels of the R, G and B signals. As a result, all the resistors R13 through R16 are active. The maximum total voltage from the resistors R12 through R16 is always applied to the amplifier 19 so that the tone level is kept at the maximum level, as shown in FIG. 2.

What is claimed is:

1. A tone control device for a display apparatus capable of producing a monochromatic tone display in response to a tone level voltage generated from red, green, and blue color signals and an intensity signal, said tone control device comprising:

first means for generating said tone level voltage at a maximum value when the intensity signal has a first value; and second means for generating said tone level voltage at one of a plurality of values, including a minimum value, said one value being determined according to the combination of said red, green, and blue color signals when said intensity signal does not have said first value.

2. The tone control device of claim 1 further including third means for generating said minimum value for said tone level voltage when said intensity signal has said first value and said red, green, and blue signals have a predetermined combination of values.

3. The tone control device of claim 1 further including means for generating said tone level voltage in synchronism with a horizontal synchronizing signal and a vertical synchronizing signal for controlling said display apparatus.

4. A tone control device for a display apparatus capable of producing monochromatic tone displays in response to a tone level voltage generated from red, green, and blue color signals and in response to an intensity signal, said tone control device comprising:

a first OR gate circuit for receiving said red, green, and blue color signals and for producing an output signal representing a logical OR of said red, green, and blue color signals;

an AND gate circuit for receiving said intensity signal and said output signal from said first OR gate and for producing an output signal representing a logical AND of said intensity signal and said output of said first OR gate;

second, third, and fourth OR gates each receiving at one input a different one of said red, green, and blue signals and each receiving at a second input said output of said AND gate; and a set of resistors each having one end connected to a corresponding one of said second through fifth OR gates and each having another end coupled together at a common junction containing said tone level voltage, each of said resistors having a different value representing a different weight to be accorded the value of said red, green, and blue signals.

5. The tone control device of claim 4 further including a pull-up resistor coupled between said junction and a first power source voltage terminal and a pull-down resistor coupled between said junction at a second power source terminal.

6. The tone control device of claim 4 further including a first inverter having an input coupled to the output of said AND gate and having an output coupled through a first coupling resistor to said common junction, and a second inverter having an input coupled to the output of said first OR gate and having an output coupled through a second coupling resistor to said common junction, wherein said first and second coupling resistors have values corresponding respectively to a maximum and minimum value of said tone level voltage.

7. The tone control device of claim 4 further including an amplifier having an input coupled to said common junction.

8. The tone control device of claim 4 further including an EXCLUSIVE OR gate for synchronizing said tone level voltage with said display apparatus, said EXCLUSIVE OR gate having an inverted output coupled to said common junction and receiving as inputs a horizontal synchronizing signal and a vertical synchronizing signal for said display apparatus and having said output.

* * * * *